US011186804B2

(12) United States Patent
Sun

(10) Patent No.: US 11,186,804 B2
(45) Date of Patent: Nov. 30, 2021

(54) STRUCTURED LIQUID DETERGENT COMPOSITION FOR A UNIT DOSE DETERGENT PACK HAVING IMPROVED STRUCTURING PROPERTIES AND SUSPENSION STABILITY

(71) Applicant: Henkel IP & Holding GmbH, Duesseldorf (DE)

(72) Inventor: Wei Sun, Trumbull, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 34 days.

(21) Appl. No.: 16/698,537

(22) Filed: Nov. 27, 2019

(65) Prior Publication Data

US 2021/0155875 A1 May 27, 2021

(51) Int. Cl.

| | |
|---|---|
| ***C11D 1/02*** | (2006.01) |
| ***C11D 1/22*** | (2006.01) |
| ***C11D 1/72*** | (2006.01) |
| ***C11D 1/83*** | (2006.01) |
| ***C11D 3/20*** | (2006.01) |
| ***C11D 3/22*** | (2006.01) |
| ***C11D 3/30*** | (2006.01) |
| ***C11D 3/37*** | (2006.01) |

(Continued)

(52) U.S. Cl.

CPC ..... *C11D 3/222* (2013.01); *C11D 1/83* (2013.01); *C11D 3/2075* (2013.01); *C11D 3/30* (2013.01); *C11D 3/3723* (2013.01); *C11D 3/43* (2013.01); *C11D 11/0017* (2013.01); *C11D 11/0023* (2013.01); *C11D 17/043* (2013.01); *C11D 1/22* (2013.01); *C11D 1/29* (2013.01); *C11D 1/72* (2013.01)

(58) Field of Classification Search

CPC .... C11D 1/02; C11D 1/22; C11D 1/72; C11D 1/83; C11D 3/20; C11D 3/2006; C11D 3/2041; C11D 3/2065; C11D 3/22; C11D 3/30; C11D 3/3723; C11D 3/43; C11D 17/042

See application file for complete search history.

(56) References Cited

U.S. PATENT DOCUMENTS

| | | | |
|---|---|---|---|
| 6,024,943 | A | 2/2000 | Ness et al. |
| 6,056,949 | A | 5/2000 | Menzi et al. |

(Continued)

FOREIGN PATENT DOCUMENTS

| | | | |
|---|---|---|---|
| WO | 9532997 | A1 | 12/1995 |
| WO | 2010069957 | A1 | 6/2010 |
| WO | 2014017913 | A1 | 1/2014 |

OTHER PUBLICATIONS

PCT Search Report Application No. PCT/US2020/061890 Completion and dated Mar. 23, 2021 11 Pages.

*Primary Examiner* — Brian P Mruk
(74) *Attorney, Agent, or Firm* — Bojuan Deng

(57) ABSTRACT

A structured liquid detergent composition includes a bacteria-derived cellulose network, a plurality of surfactants including an anionic surfactant and a nonionic surfactant with a weight ratio of the linear alkylbenzene sulfonate to the nonionic surfactant being from about 0.5 to about 5.0, a non-aqueous solvent, and water. Also disclosed is a unit dose detergent pack including a pouch formed from a water-soluble film and the structured liquid detergent composition releasably disposed within the pouch.

19 Claims, 1 Drawing Sheet

(51) Int. Cl.

| | |
|---|---|
| ***C11D 3/43*** | (2006.01) |
| ***C11D 17/04*** | (2006.01) |
| ***C11D 11/00*** | (2006.01) |
| *C11D 1/29* | (2006.01) |

(56) References Cited

U.S. PATENT DOCUMENTS

| | | | | |
|---|---|---|---|---|
| 6,194,375 | B1 | 2/2001 | Ness et al. | |
| 6,458,754 | B1 | 10/2002 | Velazquez et al. | |
| 7,776,807 | B2 | 8/2010 | Canto et al. | |
| 7,888,308 | B2 | 2/2011 | Swazey | |
| 7,981,855 | B1 | 7/2011 | Palla-Venkata et al. | |
| 7,994,111 | B2 | 8/2011 | Caggioni et al. | |
| 8,426,353 | B2 | 4/2013 | Ouali et al. | |
| 8,642,529 | B2 | 2/2014 | Palla-Venkata et al. | |
| 8,703,691 | B2 | 4/2014 | Caggioni et al. | |
| 8,716,213 | B2 | 5/2014 | Caggioni et al. | |
| 9,045,715 | B2 | 6/2015 | Josten et al. | |
| 9,752,108 | B2 | 9/2017 | Guida et al. | |
| 10,030,214 | B2 | 7/2018 | Swazey et al. | |
| 10,066,195 | B2 | 9/2018 | Kueleers et al. | |
| 2008/0214424 | A1 | 9/2008 | Barnwell et al. | |
| 2010/0009891 | A1 | 1/2010 | Canto et al. | |
| 2011/0224127 | A1 | 9/2011 | Blyth et al. | |
| 2012/0208737 | A1* | 8/2012 | Caggioni ..... | C11D 17/0026 510/418 |
| 2016/0040099 | A1 | 2/2016 | Maes et al. | |
| 2017/0335237 | A1 | 11/2017 | Fossum et al. | |
| 2018/0216033 | A1 | 8/2018 | Camire et al. | |

* cited by examiner

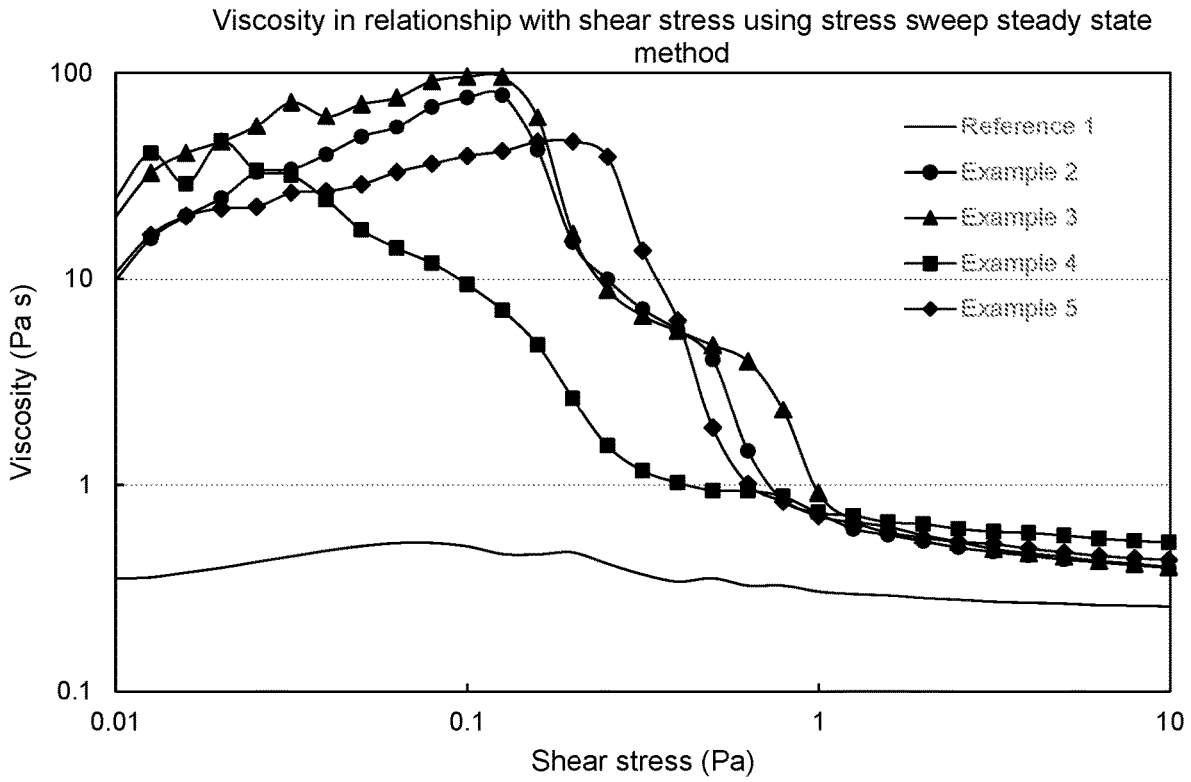
Viscosity in relationship with shear stress using stress sweep steady state method
100
10
1
0.1
Viscosity (Pa s)
0.01
0.1
1
10
Shear stress (Pa)
Reference 1
Example 2
Example 3
Example 4
Example 5

STRUCTURED LIQUID DETERGENT COMPOSITION FOR A UNIT DOSE DETERGENT PACK HAVING IMPROVED STRUCTURING PROPERTIES AND SUSPENSION STABILITY

FIELD OF THE INVENTION

The present disclosure relates generally to a structured liquid detergent composition for a unit dose detergent pack with improved structuring properties and suspension stability.

BACKGROUND OF THE INVENTION

Liquid detergent compositions including laundry and dishwasher detergents are often formulated for the delayed release of various active agents such as fragrances, skin care agents, textile care agents, etc. In an example, many liquid detergent compositions are formulated to include particulate components, such as microcapsules, adapted to deliver or release the active agents during a wash cycle. The particulate components are desirably dispersed within a liquid phase of the detergent composition; however, the particulate components may, in some instances, settle out of the liquid phase. Therefore, the liquid detergent composition should be formulated to have a suitably high viscosity to minimize random movement of the particulate components. This allows the particulate components to remain suspended within the liquid phase of the detergent composition for an appreciable amount of time after the detergent composition has been formulated.

Structuring agents have been added to liquid detergent compositions to provide a structural network to stabilize the particulate components in the detergent composition. In some instances, however, formation of a suitable structural network by the structuring agent in a compact liquid detergent composition disposed in a unit dose detergent article may be a challenge. For example, a high concentration of surfactants (e.g., at least 35% by weight) typically present in the compact liquid detergent composition could interfere or impair the structural network provided by the structuring agent. Additionally, a low water content which is also typically present in the compact liquid detergent composition could limit the ability of the structuring agent to expand or swell into the desired structural network. This would compromise the structuring properties of the structuring agent. Therefore, there remains a need for improvement.

BRIEF SUMMARY OF THE INVENTION

The present disclosure provides a structured liquid detergent composition. In an embodiment, the composition comprises a bacteria-derived cellulose network, a plurality of surfactants including a linear alkylbenzene sulfonate and a nonionic surfactant with a ratio of the linear alkylbenzene sulfonate to the nonionic surfactant being from about 0.6 to about 5.0, a non-aqueous solvent, and water.

In another embodiment, the structured liquid detergent composition comprises from about 0.01 to about 0.10% by weight of a bacteria-derived cellulose network based on a total weight of the structured liquid detergent composition, from about 20 to about 60% by weight of a plurality of surfactants based on a total weight of the structured liquid detergent composition wherein the plurality of surfactants includes a linear alkylbenzene sulfonate and an alcohol ethoxylate with a weight ratio of the linear alkylbenzene sulfonate to the alcohol ethoxylate being from about 0.8 to about 3.3, at least 20% by weight of a non-aqueous solvent based on a total weight of the structured liquid detergent composition, and a balance being water, wherein the structured liquid detergent composition has a low-stress viscosity of at least 20 Pa·s based on a maximum viscosity measured at a shear stress of from about 0.01 to about 0.2 Pa and a ratio of low-stress viscosity to high-stress viscosity of at least 50 measured at a shear stress of about 10 Pa using an AR2000 rheometer using a 2 degree cone with 52 μm truncation at 25° C.

The present disclosure further provides a unit dose detergent pack comprising a pouch formed from a water-soluble film and a structured liquid detergent composition releasably disposed within the pouch. The structured liquid detergent composition includes a bacteria-derived cellulose network, a plurality of surfactants including a linear alkylbenzene sulfonate and a nonionic surfactant with a weight ratio of the linear alkylbenzene sulfonate to the nonionic surfactant being from about 0.6 to about 5.0, a non-aqueous solvent, and water.

BRIEF DESCRIPTION OF THE DRAWING

The advantages of the present disclosure will be readily appreciated as the same becomes better understood by reference to the following detailed description when considered in connection with the accompanying drawing.

FIG. 1 is a graph showing steady-state viscosity curves of a structured liquid detergent reference sample and five structured liquid detergent samples according to various embodiments of the present disclosure.

DETAILED DESCRIPTION OF THE INVENTION

The following detailed description is merely exemplary in nature and is not intended to limit the structured liquid detergent composition or the unit dose detergent article of the present disclosure. Furthermore, there is no intention to be bound by any theory presented in the preceding background or the following detailed description.

Embodiments of a structured liquid detergent composition and a unit dose detergent pack including the structured liquid detergent composition are described in detail below. The structured liquid detergent composition includes a bacteria-derived cellulose network as a structuring agent, a plurality of surfactants including a linear alkylbenzene sulfonate and a nonionic surfactant, a non-aqueous solvent, and water. It was unexpectedly discovered that the structured liquid detergent composition, which utilizes a the bacteria-derived cellulose network as a structuring agent, has surprisingly improved structuring properties (e.g., a high low-shear viscosity and a high ratio of low-stress viscosity to high-stress viscosity) and suspension stability when a weight ratio of the linear alkylbenzene sulfonate to the nonionic surfactant present in the composition is from about 0.6 to about 5.0, and more preferably from 0.8 to 3.3.

As used herein, the term "detergent" refers to a substance, preparation, agent, and/or the like containing a mixture of surfactants having cleansing properties. One example is a laundry detergent, which is a detergent formulated for washing or cleaning laundry. Another example is dishwashing detergent, which is a detergent formulated for washing or cleaning dishware, drinking glasses, eating or cooking utensils, etc. The detergent may be specifically formulated for use in washing and cleaning processes performed with a washing machine or for use in washing and cleaning processes performed by hand.

Additionally, the term "structured liquid detergent" refers to a liquid detergent that includes an ingredient or component that forms a structural network to allow for the stabilization or suspension of particulate components, such as fragrances, etc. The structured liquid detergent composition of the present disclosure is externally structured, meaning that the structural network is formed by a nonsurfactant. For example, in the present disclosure, the structural network of the composition is formed by the bacteria-derived cellulose. It should be appreciated that internal structuring (i.e., a structural networking created by surfactants) could also be present.

Bacteria-Derived Cellulose Network

As mentioned above, the structured liquid detergent composition includes a bacteria-derived cellulose network as a structuring agent. In an embodiment, the cellulose is produced by the fermentation of *Acetobacter* microorganisms. The bacteria-derived cellulose network may be any cellulose network produced as a fermentation product of the *Acetobacter* microorganisms. In an embodiment, the bacteria-derived cellulose network is an aerobic cultured product of the fermentation of the *Acetobacter* microorganisms having a highly reticulated branching and interconnected network of fibers that are insoluble in water. In an embodiment, the bacteria-derived cellulose network may be produced aerobically under agitated culture conditions using a bacterial strain of *Acetobacter aceti* var. *xylinum*. Use of agitated culture conditions can result in sustained production over an average of 70 hours of at least 0.1 g/L per hour of the cellulose product.

The bacteria-derived cellulose network may be processed in a hydrophilic solvent, such as water, polyols (e.g., ethylene glycol, glycerin, polyethylene glycol, etc.), or combinations thereof. This processing may be referred to as activation and includes high pressure homogenization and/or high shear mixing. By activating the bacteria-derived cellulose under sufficiently intense processing conditions, an increase in yield stress (i.e., the force required to initiate flow in a gel-like system) of the bacteria-derived cellulose network may be achieved. It is believed that the yield stress is indicative of the suspension ability of the liquid detergent composition, as well as the ability to remain in situ after application to a vertical surface.

During activation, the 3-dimensional structure of the bacteria-derived cellulose is modified such that the cellulose imparts functionality to the solvent in which the activation occurs or to a composition to which the activated cellulose is added. Functionality includes providing properties such as shear-thickening, imparting yield stress-suspension properties, freeze-thaw and heat stability, etc. The processing followed during activation disperses the cellulose in the solvent and teases apart the cellulose fibers to expand the cellulose fibers. The activation of the cellulose expands the cellulose to create the bacteria-derived cellulose network, which is a reticulated network of highly intermeshed fibers with a high surface area. In an embodiment, the surface area of the bacteria-derived cellulose network is at least 200-fold higher than conventional microcrystalline cellulose (i.e., cellulose formed from plant sources).

The bacteria-derived cellulose network is present in the structured liquid detergent composition in an amount of from 0.001 to 1% by weight based on a total weight of the detergent composition. In another embodiment, the bacteria-derived cellulose network is present is an amount of from about 0.005 to about 0.500% by weight based on a total weight of the detergent composition. In yet another embodiment, the bacteria-derived cellulose network is present is an amount of from about 0.01 to about 0.10% by weight based on a total weight of the detergent composition. In a particular embodiment, the amount of the bacteria-derived cellulose network is about 0.023% by weight based on a total weight of the detergent composition.

Surfactants

The structured liquid detergent composition further includes a plurality of surfactants. The surfactants are used in the composition to facilitate foaming and stain removal, as well as to minimize redeposition of soils onto a fabric. The plurality of surfactants includes anionic and nonionic surfactants. In an embodiment, the plurality of surfactants includes linear alkylbenzene sulfonate (as an anionic surfactant) and a nonionic surfactant. As mentioned above, it was unexpectedly discovered that the structured liquid detergent composition has surprisingly improved structuring properties (e.g., a high low-shear viscosity and a high ratio of low-stress viscosity to high-stress viscosity) and suspension stability when a weight ratio of the linear alkylbenzene sulfonate (LAS) to the nonionic surfactant is from about 0.6 to about 5.0. In another embodiment, the improved structuring properties and suspension stability occurs when the weight ratio of the LAS to the nonionic surfactant is from about 0.6 to about 4.0. In yet another embodiment, the improved structuring properties and suspension stability occurs when the weight ratio of the anionic surfactant to the nonionic surfactant is from about 0.8 to about 3.3.

Additionally, the structured liquid detergent composition of the present disclosure has a high concentration of surfactants, e.g., at least 20% by weight of surfactants is present in the composition. In an embodiment, the amount of surfactants present in the composition is from about 20 to about 70% by weight based on a total weight of the structured liquid detergent composition. In another embodiment, the amount of the plurality of surfactants present in the composition is from about 20 to about 60% by weight based on a total weight of the structured liquid detergent composition. In yet another embodiment, the amount of the plurality of surfactants present in the composition is from about 20 to about 50% by weight based on a total weight of the structured liquid detergent composition.

The linear alkylbenzene sulfonate is a water-soluble salt of a linear alkyl benzene sulfonate having from 8 to 22 carbon atoms of the linear alkyl group. The salt may be an alkali metal salt or an ammonium, alkylammonium, alkanolammonium salt. In an embodiment, the linear alkylbenzene sulfonate includes an alkali metal salt of $C_{10}$-$C_{16}$ alkyl benzene sulfonic acids, such as $C_{11}$-$C_{14}$ alkyl benzene sulfonic acids. Suitable linear alkylbenzene sulfonates include sodium and potassium linear, alkylbenzene sulfonates with the average number of carbon atoms in the alkyl group being from 11 to 14. In one example, sodium $C_{11}$-$C_{14}$ linear alkylbenzene sulfonate is a suitable anionic surfactant for the structured liquid detergent composition. In an embodiment, the linear alkylbenzene sulfonate is present in an amount of from about 1 to about 40% by weight based on a total weight of the composition. In another embodiment, the linear alkylbenzene sulfonate is present in an amount of from about 5 to about 35% by weight. In yet another embodiment, the linear alkylbenzene sulfonate is present in an amount of from about 8 to about 30% by weight. In still another embodiment, the linear alkylbenzene sulfonate is present in an amount of from about 10 to about 25% by weight.

It should be appreciated that the structured liquid detergent composition could include one or more anionic surfactants, such as an alcohol ethoxy sulfate (also known as an alkyl ether sulfate or an alkyl polyethoxylated sulfate), in addition to the linear alkylbenzene sulfonate. Non-limiting examples of alcohol ethoxy sulfates are found in United States Patent Publication No. 2018/0216033 (U.S. application Ser. No. 15/879,933) owned by the Applicant of the subject application, the relevant portion(s) of which is incorporated herein by reference.

The nonionic surfactant may be chosen from a wide range of nonionic surfactants. In an embodiment, the nonionic surfactant is chosen from, but not limited to, alkoxylated alcohols, polyoxyalkylene alkyl ethers (such as those under the tradename PLURONIC® available from BASF Corp. (Ludwigshafen, Germany)), polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. In another embodiment, the non-ionic surfactant is an alcohol ethoxylate (AE).

The alcohol ethoxylate may be primary and secondary alcohol ethoxylates, such as $C_8$-$C_{20}$ aliphatic alcohols ethoxylated with an average of from 1 to 20 moles of ethylene oxide per mole of alcohol. In another embodiment, the alcohol ethoxylate is a $C_{10}$-$C_{15}$ primary and secondary aliphatic alcohol ethoxylated with an average of from 1 to 10 moles, or from 3 to 8 moles of ethylene oxide per mole of alcohol.

Examples of alcohol ethoxylates include, but are not limited to, the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may be end-capped by a hydroxylated alkyl group.

In one embodiment, the alcohol ethoxylate has the Formula (1):

$$R_2\text{-}(\text{—O—}C_2H_4\text{—})_m\text{—OH}$$

wherein $R_2$ is a hydrocarbyl group having 8 to 16 carbon atoms and M is a number from 1 to 20. In another embodiment, $R_2$ is a hydrocarbyl group having 8 to 14 carbon atoms, 8 to 12 carbon atoms, or 8 to 10 carbon atoms, and M is a number from 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. In an embodiment, $R_2$ is a linear or branched $C_8$-$C_{16}$ alkyl, $C_8$-$C_{14}$ alkyl, or $C_8$-$C_{10}$ alkyl group. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

Non-limiting examples of the alcohol ethoxylate include TOMADOL® available from Evonik Corp. (Essen, Germany) and NEODOL® available from Shell Global (The Hague, The Netherlands).

In an embodiment, the total amount of the nonionic surfactant(s) present is from about 1 to about 40% by weight based on a total weight of the composition. In another embodiment, the total amount of the nonionic surfactant(s) present is from about 3 to about 30% by weight. In yet another embodiment, the total amount of the nonionic surfactant(s) present is from about 5 to about 25% by weight. In another embodiment, the total amount of the nonionic surfactant(s) present is from about 20 to about 30% by weight.

It should be appreciated that, in certain embodiments, the plurality of surfactants could also include additional surfactants, such as but not limited to, cationic surfactants, amphoteric (zwitterionic) surfactants, etc. In other embodiments, the structured liquid detergent composition is free of additional surfactants including cationic surfactants, amphoteric (zwitterionic) surfactants, etc.

Non-Aqueous Solvent

The structured liquid detergent composition includes a non-aqueous solvent. In an embodiment, the non-aqueous solvent is further defined as an organic solvent and is used in the composition to help solubilize the plurality of surfactants to maintain homogeneity of the composition at various storage conditions and to keep the viscosity of the composition in a range for easy processing and manufacturing. Additionally, the non-aqueous solvent serves as a water-binding agent to reduce water activity of the composition to reduce water transfer of the composition to the surrounding water-soluble container of the unit dose detergent pack to avoid or reduce swelling and leakage through the water-soluble film material of the container. The unit dose detergent pack is described below.

In an embodiment, the structured liquid detergent composition includes at least one non-aqueous solvent. In another embodiment, the structured liquid detergent composition includes at least two non-aqueous solvents. For instance, the non-aqueous solvent is one of a plurality of non-aqueous solvents with the plurality of non-aqueous solvents being different from one another. The non-aqueous solvent(s) include monovalent or polyvalent alcohols or glycol ethers. Non-limiting examples of the non-aqueous solvent(s) include ethanol, propylene glycol, butylene glycol, pentylene glycol, hexylene glycol, heptylene glycol, octylene glycol, diethylene glycol, triethylene glycol, 2-methyl-1,3-propanediol, glycerol, 1,3-propanediol, triacetin, ethyl acetate, benzyl alcohol, polyethylene glycol having a molecular weight of from 200 to 3000 g/mol, and combinations thereof. In an embodiment, the composition includes propylene glycol, ethanol, and glycerol.

Since the structured liquid detergent composition has a high surfactant concentration, the inventors of the subject disclosure have found that the composition needs at least 10% by weight of the non-aqueous solvent(s) to maintain homogeneity over the shelf life of the composition. Additionally, a non-aqueous solvent loading of at least 10% by weight is needed in order to maintain a robust stability of the composition and to maintain the integrity of the water-soluble unit dose article. In another embodiment, the structured liquid detergent composition has at least 20% by weight of the non-aqueous solvent(s). In yet another embodiment, the non-aqueous solvent(s) is present in an amount of from about 10 to about 50% by weight based on a total weight of the structured liquid detergent composition. In yet another embodiment, the non-aqueous solvent(s) is present in an amount of from about 15 to about 45% by weight based on a total weight of the structured liquid detergent composition. In yet another embodiment, the non-aqueous solvent(s) is present in an amount of from about 20 to about 40% by weight based on a total weight of the structured liquid detergent composition.

Fatty Acid

In an embodiment, the structured liquid detergent composition furthers include a fatty acid or a salt thereof. Non-limiting examples of suitable fatty acids include carboxylic acid, lauric acid, myristic acid, palmitic acid, stearic acid, topped palm kernel fatty acid, coconut fatty acid, and combinations thereof. In an embodiment, the fatty acid is a carboxylic acid, such as one having a long unbranched aliphatic tail. The carboxylic acid may be saturated or unsaturated. In another embodiment, the fatty acid is an ethoxylated fatty acid, such as an ethoxylated carboxylic acid. In an embodiment, the fatty acid salt is a sodium salt, such as $C_{12}$-$C_{18}$, or more preferably $C_{12}$-$C_{14}$ saturated and/or unsaturated fatty acid and alkali or alkali earth metal carbonates, e.g., sodium carbonate. The fatty acid or fatty acid salt may be present in an amount of from about 1 to about 20% by weight based on a total weight of the structured liquid detergent composition. In another embodiment, the fatty acid or fatty acid salt is present in an amount of from about 3 to about 15% by weight. In an embodiment, the structured liquid detergent composition includes about 10% by weight of a fatty acid or fatty acid salt.

Water

The structured liquid detergent composition may further include water. In an embodiment, water is present in an amount of from 0 to about 30% by weight based on a total weight of the structured liquid detergent composition. In another embodiment, water is present in an amount of about 5 to about 25% by weight. In yet another embodiment, water is present in an amount of about 10 to about 20% by weight. In a particular embodiment, about 14% by weight of water is present in the structured liquid detergent composition.

Additives

In certain embodiments, the structured liquid detergent composition further includes at least one additive. A suspension polymer, such as an alkoxylated polyethyleneimine, may be used in the composition. In an embodiment, the alkoxylated polyethyleneimine has a polyethyleneimine backbone having a weight average molecular weight from about 300 to about 10,000. The polyethyleneimine backbone may be modified by either (1) one or two alkoxylation modifications per nitrogen atom depending, at least in part, on whether the modification occurs at an internal nitrogen atom or at a terminal nitrogen atom, in the polyethyleneimine backbone, the alkoxylation modification including the replacement of a hydrogen atom by a polyalkylene chain having an average of about 1 to about 40 alkoxy moieties per modification with the terminal alkoxy moiety of the alkoxylation modification capped with hydrogen, a $C_1$-$C_4$ alkyl, or combinations thereof, (2) a substitution of one $C_1$-$C_4$ alkyl moiety and one or two alkoxylation modifications per nitrogen atom depending, at least in part, on whether the substitution occurs at an internal nitrogen atom or at an terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety capped with hydrogen, a $C_1$-$C_4$ alkyl, or combinations thereof, or (3) a combination of (1) and (2).

The alkoxylation modification of the polyethyleneimine backbone includes the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. In some embodiments, the polyalkoxylene chain is selected from ethoxy moieties and ethoxy/propoxy block moieties. The polyalkoxylene chain may be ethoxy moieties in an average degree of from about 5 to about 15 or the polyalkoxylene chain may be ethoxy/propoxy block moieties having an average degree a ethoxylation from about 5 to about 15 and an average degree of propoxylation from about 1 to about 16.

One specific alkoxylated polyethyleneimine has the general structure of Formula (2):

(2)

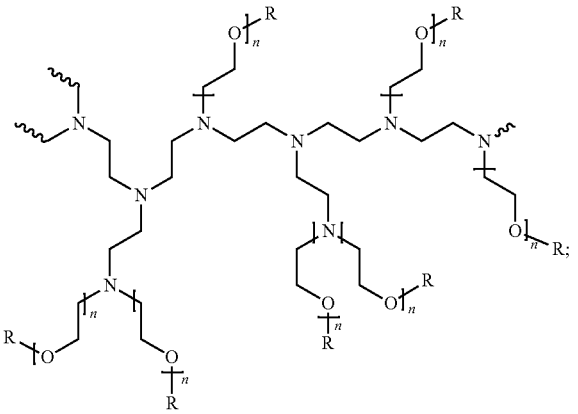

wherein the polyethyleneimine backbone has a weight average molecular weight of 600, n of has an average of 20, and R is selected from hydrogen, a $C_1$-$C_4$ alkyl, and combinations thereof.

In an embodiment, the suspension polymer is polyethyleneimine ethoxylate present in an amount of from about 0.1 to about 6% by weight based on a total weight of the structured liquid detergent composition. In another embodiment, the suspension polymer is polyethyleneimine ethoxylate present in an amount of about 4.8% by weight based on a total weight of the structured liquid detergent composition.

The composition may further include, as an additive, a bittering agent. The bittering agent imparts a bitter taste to the structured liquid detergent composition thereby hindering accidental ingestion of the composition by children, animals, etc. Non-limiting examples of bittering agents include denatonium benzoate (such as BITREX® available from Bitrex (Edinburgh, Scotland)), aloin, and/or the like. The bittering agent is present in an amount of from 0 to about 1% by weight based on a total weight of the structured liquid detergent composition. In another embodiment, the bittering agent is present in an amount of from 0 to about 0.5% by weight, or more preferably, from 0 to about 0.1% by weight. In an embodiment, the structured liquid detergent composition includes about 0.05% by weight of the bittering agent based on a total weight of the structured liquid detergent composition.

The composition may further include, as an additive, a neutralizing agent. The neutralizing agent is chosen from an alkanolamine, a hydroxide, and combinations thereof. Non-limiting examples of the alkanolamine include monoethanolamine, diethanolamine, triethanolamine, isopropylamine, and/or the like. Non-limiting examples of the hydroxide include sodium hydroxide, potassium hydroxide, ammonium hydroxide, calcium hydroxide, and/or the like. In an embodiment, the neutralizing agent is present in an amount of from about 2 to about 8% by weight based on a total weight of the structured liquid detergent agent. In another embodiment, the neutralizing agent is monoethanolamine present in an amount of from about 2.5 to about 7.5% by weight.

The composition may further include, as an additive, one or more enzymes. The enzymes may be chosen amylolytic, proteolytic, cellulolytic, and/or lipolytic-type enzymes. Other suitable enzymes include, but are not limited to, proteases, amylases, lipases, and cellulases such as ALCALASE® (bacterial protease), EVERLASE® (protein-engineered variant of SAVINASE®), ESPERASE® (bacterial protease), LIPOLASE® (fungal lipase), LIPOLASE ULTRA®) (Protein-engineered variant of LIPOLASE®), LIPOPRIME® (protein-engineered variant of LIPOLASE®), TERMAMYL® (bacterial amylase), BAN (Bacterial Amylase Novo), CELLUZYME® (fungal enzyme), and CAREZYME® (monocomponent cellulase), all available from Novo Nordisk Industries A/S (Bagsvaerd, Denmark). Blends of two or more enzymes may also be used, such as a protease/lipase blend, a protease/amylase blend, a protease/amylase/lipase blend, etc.

As another additive, the composition may include an optical brightener. Suitable optical brighteners include stilbenes such as TINOPAL® AMS available from BASF Corp., distyrylbiphenyl derivatives such as TINOPAL® CBS-X also available from BASF Corp, stilbene/naphthotriazole blends (e.g., TINOPAL® RA-16), oxazole derivatives, and/or coumarin brighteners.

An antifoam agent may also be used to reduce or hinder the formation of foam. Suitable antifoam agents include, but are not limited to, a polyalkoxylated alkanolamide, amide, amine oxide, betaine, sultaine, $C_8$-$C_{18}$ fatty alcohols, and those disclosed in U.S. Pat. No. 5,616,781, the relevant portion(s) of which is incorporated hereby by reference. An auxiliary foam stabilizing surfactant, such as a fatty acid amide surfactant, may also be included in the composition, such as $C_8$-$C_{20}$ alkanol amides, monoethanolamides, diethanolamides, or isopropanolamides. Other suitable antifoam agents include those derived from phenylpropylmethyl substitute polysiloxanes.

The composition may further include a dye transfer inhibitor to help prevent colorants (e.g., a dye) from coming off a fabric and being deposited onto another fabric during a washing cycle. The dye transfer inhibitors are polymers adapted to entrap dyes in the washing liquor. Non-limiting examples of dye transfer inhibitors include homopolymers and copolymers of vinylpyrrolidone and vinylimidazole.

As another additive, the composition may include a soil release agent. Suitable soil release agents are polymers such as, but not limited to, a nonionic polyester of polypropylene terephthalate such as TEXCARE® SRN available from Clariant, a polyethylene glycol polyester such as REPEL-O-TEX SRP available from Solvay, end-capped and non-end-capped sulfonated and unsulfonated PET/POET polymers of the type as disclosed in International Patent Publication Nos. WO2010/069957 and WO1995/032997, the relevant portions of which are incorporated herein by reference, polyethylene glycol/polyvinyl alcohol graft copolymers such as SOKALAN HP 22 available from BASF Corp., and/or anionic hydrophobic polysaccharides.

Colorants and fragrances may also be used, as additives, in the composition. Colorants suitable for use in the structured liquid detergent composition include dyes of a variety of different colors, such as blue, yellow, green, orange, green, purple, etc. Suitable dyes include, but are not limited to, chromophore types such as azo, anthraquinone, triarylmethane, methine quinophthalone, azine, oxazine, and thiazine which may be of any desired color, hue or shade. Suitable dyes may be obtained from Clariant, Ciba Specialty Chemicals, Dystar, Avecia, Bayer, or any other suitable manufacturer.

Fragrances may include any fragrant substance or mixture of substances including natural fragrances (such as those extracted from flowers, herbs, leaves, roots, barks, woods, blossoms, plants, etc.), artificial fragrances (such as natural oils or oil constituents), encapsulated, and synthetically produced fragrances. Non-limiting examples of fragrances that may be used in the composition are set forth in U.S. Pat. Nos. 6,024,943; 6,056,949; 6,194,375; 6,458,754; 8,716,213; and 8,426,353 and in United States Patent Publication Nos. 2011/0224127 and 2017/0335237, the relevant portions of which are incorporated herein by reference.

The composition may further include, as another additive, an antimicrobial agent. Suitable antimicrobial agents include an antimicrobial, a germicide, or a fungicide. In an embodiment, the antimicrobial agent may be triclosan (5-chloro-2-(2,4-dichloro-phenoxy) phenol)), and/or the like.

Additional additives that may be incorporated into the structured liquid detergent composition include chelators, water softeners, buffers, processing aids, preservatives, and/or the like.

Structuring Properties

The structuring network of the liquid detergent composition is considered robust when both a high low-stress viscosity and a high ratio of low-stress viscosity to high-stress viscosity is present. In an embodiment, the liquid detergent composition has a robust structuring network when the low-stress viscosity is at least 3 Pa·s based on a maximum viscosity measured at a shear stress of from about 0.01 to about 0.2 Pa and the ratio of low-stress viscosity to high-stress viscosity is at least 10. In another embodiment, the liquid detergent composition has a robust structuring network when the low-stress viscosity is at least 20 Pa·s based on a maximum viscosity measured at a shear stress of from about 0.01 to about 0.2 Pa and the ratio of low-stress viscosity to high-stress viscosity is at least 50. In another embodiment, the liquid detergent composition has a robust structuring network when the low-stress viscosity is at least 40 Pa·s based on a maximum viscosity measured at a shear stress of from about 0.01 to about 0.2 Pa and the ratio of low-stress viscosity to high-stress viscosity is at least 80. In one particular embodiment, the liquid detergent composition has a robust structuring network when the low-stress viscosity is at least 46 Pa·s based on a maximum viscosity measured at a shear stress of from about 0.01 to about 0.2 Pa and the ratio of low-stress viscosity to high-stress viscosity is at least 88.

Unit Dose Detergent Pack

A unit dose detergent pack includes a pouch formed or made from a water-soluble film and the structured detergent composition releasably disposed within the pouch. Details of various embodiments of the structured liquid detergent composition are described above. The pouch defines at least one compartment and the structured liquid detergent composition is releasably disposed or encapsulated within the at least one compartment. The pouch may have a single compartment and the structured liquid detergent composition is releasably disposed within the single compartment. Alternatively, the pouch may have two or more compartments and the structured liquid detergent composition is releasably disposed within at least one of the two or more compartments. The other compartment(s) may include colorants or other components.

The pouch may be formed from a single continuous water-soluble film. In another embodiment, the pouch is formed from a plurality of water-soluble films joined and sealed to one another, such as along their edges such that the inner surfaces of the water-soluble films collective define the compartment. In an embodiment, the film is water-soluble such that the film completely dissolves when exposed to water, such as in a washing machine for washing laundry. When the film dissolves, the pouch ruptures and the contents of the pouch (e.g., the structured liquid detergent composition) are released. As used herein, the term "water-soluble" means that at least 2 grams of the solute (e.g., the film) dissolves in 5 liters of solvent (e.g., water) for a solubility of at least 0.4 grams per liter (g/l) at a temperature of 25° C. unless otherwise specified.

The film is desirably strong, flexible, shock resistant, and non-tacky during storage at both high and low temperatures and high and low humidities. Non-limiting examples of suitable materials for the water-soluble film include polyvinyl alcohol, polyvinyl acetate, film-forming cellulosic polymers, polyacrylic acid, polyacrylamide, polyanhydride, polysaccharide, and combinations thereof.

The following examples are meant to illustrate the invention and are not to be viewed in any way as limiting the scope of the present claims.

Examples

Six samples of a structured liquid detergent composition were prepared. One of the samples (Reference 1) was prepared as a reference composition, and five of the samples (Examples 2-5) are compositions representative of the present disclosure. The compositions of Reference 1 and Examples 2-5 are set forth in the table below.

| Ingredient | Reference 1 | Example 2 | Example 3 | Example 4 | Example 5 |
|---|---|---|---|---|---|
| Alcohol ethoxylate (wt. %) | 22.6 | 14.5 | 14.6 | 5.1 | 6.7 |
| Linear alkylbenzene sulfonate (wt. %) | 13.1 | 12.4 | 20.3 | 10.4 | 21.8 |
| alkyl ethoxylate sulfate-Na (wt. %) | 6.1 | 15.2 | 5.6 | 26.9 | 11.7 |
| Fatty Acid (wt. %) | 10.0 | 10.0 | 10.0 | 10.0 | 10.0 |
| Monoethanolamine (wt. %) | 5.36 | 5.21 | 6.81 | 4.58 | 7.12 |
| Polyethyleneimine ethoxylate (wt. %) | 4.80 | 4.80 | 4.80 | 4.80 | 4.80 |
| Distyryl biphenyl disulfonate (wt. %) | 0.20 | 0.20 | 0.20 | 0.20 | 0.20 |
| Bitrex (wt. %) | 0.05 | 0.05 | 0.05 | 0.05 | 0.05 |
| Glycerol (wt. %) | 11.81 | 11.57 | 11.43 | 11.55 | 11.16 |
| Propylene glycol (wt. %) | 8.21 | 8.21 | 8.21 | 8.21 | 8.21 |
| Ethanol (wt. %) | 3.12 | 3.12 | 3.12 | 3.12 | 3.12 |
| Water (wt. %) | 14.02 | 14.02 | 14.02 | 14.02 | 14.02 |
| Bacteria-derived cellulose (wt. %) | 0.023 | 0.023 | 0.023 | 0.023 | 0.023 |
| LAS to anionic surfactant ratio | 0.58 | 0.85 | 1.38 | 2.02 | 3.25 |
| Low-stress viscosity (Pa · s) | 0.52 | 77.86 | 95.90 | 46.29 | 46.24 |
| High-stress viscosity (Pa · s) | 0.24 | 0.40 | 0.40 | 0.53 | 0.43 |
| Ratio of low-stress viscosity to high-stress viscosity | 2 | 197 | 242 | 88 | 107 |

The viscosity test was conducted in an AR2000 rheometer available from TA Instruments using a 2-degree cone with a 52 μm truncation at 25° C. Each sample was applied with a steady state flow step method starting with a conditioning step of 2 rad/s angular velocity for 30 seconds and equilibrated for 15 minutes. Then each sample was applied with a steady state flow step of ramping shear stress from 0.01 Pa to 10 Pa with 5% tolerance and maximum steady state time of 1 minute per stress point. The low-shear viscosity was the maximum viscosity value observed at a shear stress of from 0.01 to 0.20 Pa and the high-shear viscosity was the viscosity value measured at 10 Pa stress. The results of the viscosity test are set forth in the table above and in the viscosity curves generated for Reference 1 and Examples 2-5 set forth in FIG. 1.

These results show that the compositions of the present disclosure (Examples 2-5) with a ratio of at least 0.8 of LAS to nonionic surfactant achieved a much higher low-stress viscosity (e.g., at least 46 Pa·s) compared to the reference composition (Reference 1). Additionally, the ratio of the low-stress to high-stress viscosity values was much higher for the compositions of the present disclosure (Examples 2-5) which was at least 88 compared to the reference composition (Reference 1) which was 2. These results show a significant and advantageous improvement in the structuring properties (i.e., low-stress viscosity and ration of low-stress to high-stress viscosity) of the compositions of the present disclosure (having a high concentration of surfactants with a ratio of LAS to non-ionic surfactant of at least 0.8) compared to the reference composition (having a high centration of surfactants with a ratio of LAS to non-ionic surfactant of less than 0.6).

As used herein, the article "a," "an," and "the" can be used herein to refer to one or more than one (i.e., to at least one) of the grammatical object of the article unless the language and/or context clearly indicates otherwise.

As used herein, the term "about" is understood by persons of ordinary skill in the art and varies to some extent depending upon the context in which the term is used. If there are uses of the term which are not clear to persons of ordinary skill in the art, given the context in which the term is used, "about" means up to plus or minus 10% of the particular term.

It is to be understood that one or more values described above may vary by +/−5%, +/−10%, +/−15%, +/−20%, etc. so long as the variance remains within the scope of the present disclosure. It is also to be understood that the appended claims are not limited to express particular compounds, compositions, or methods described in the detailed description, which may vary between particular embodiments which fall within the scope of the appended claims.

It is also to be understood that any ranges or subranges relied upon in describing the various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. Additionally, an individual number within a disclosed range may be relied upon and provides adequate support for specific embodiments within the scope of the appended claims. For example, a range "of from about 100 to about 200" includes various individual integers such as 101, 102, 103, etc., as well as individual numbers including a decimal point (or fraction) such as 100.1, 100.2, etc., which may be relied upon and provide adequate support for specific embodiments within the scope of the appended claims.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A structured liquid detergent composition comprising:

a bacteria-derived cellulose network;

a plurality of surfactants including a linear alkylbenzene sulfonate and a nonionic surfactant with a weight ratio of said linear alkylbenzene sulfonate to said nonionic surfactant being from about 0.5 to about 5.0;

a suspension polymer that is polyethyleneimine ethoxylate present in an amount of from about 0.1 to about 6.0% by weight based on a total weight of said structured liquid detergent composition;

a non-aqueous solvent; and water.

2. The structured liquid detergent composition as set forth in claim 1 wherein said structured liquid detergent composition has a low-stress viscosity of at least 3 Pa·s based on a maximum viscosity measured at a shear stress of from about 0.01 to about 0.20 Pa and a ratio of low-stress viscosity to high-stress viscosity of at least 10 measured at a shear stress of 10 Pa using an AR2000 rheometer using a 2 degree cone with 52 μm truncation at 25° C.

3. The structured liquid detergent composition as set forth in claim 1 wherein said weight ratio of said linear alkylbenzene sulfonate to said nonionic surfactant is from about 0.6 to about 3.3.

4. The structured liquid detergent composition as set forth in claim 1 wherein said non-aqueous solvent is present in an amount of at least 20% by weight based on a total weight of said structured liquid detergent composition.

5. The structured liquid detergent composition as set forth in claim 1 wherein said non-aqueous solvent is present in an amount of from about 20 to about 50% by weight based on a total weight of said structured liquid detergent composition.

6. The structured liquid detergent composition as set forth in claim 1 wherein said non-aqueous solvent is chosen from ethanol, propylene glycol, butylene glycol, pentylene glycol, hexylene glycol, heptylene glycol, octylene glycol, diethylene glycol, triethylene glycol, 2-methyl-1,3-propanediol, glycerol, 1,3-propanediol, triacetin, ethyl acetate, benzyl alcohol, polyethylene glycol having a molecular weight of from 200 to 3000 g/mol, and combinations thereof.

7. The structured liquid detergent composition as set forth in claim 1 wherein said plurality of surfactants is present in an amount of from about 5 to about 60% by weight based on a total weight of said structured liquid detergent composition.

8. The structured liquid detergent composition as set forth in claim 1 wherein said nonionic surfactant is an alcohol ethoxylate.

9. The structured liquid detergent composition as set forth in claim 1 wherein said bacteria-derived cellulose network includes cellulose produced by the fermentation of *Acetobacter* microorganisms.

10. The structured liquid detergent composition as set forth in claim 1 wherein said bacteria-derived cellulose network is present in an amount of from 0.001 to 1% by weight based on a total weight of the detergent composition.

11. The structured liquid detergent composition as set forth in claim 1 further comprising monoethanolamine as a neutralizing agent present in an amount of from about 2.5 to about 7.5% by weight based on a total weight of the structured liquid detergent composition.

12. The structured liquid detergent composition as set forth in claim 1 further comprising a fatty acid or salt thereof present in an amount of from about 3 to about 15% by weight based on a total weight of the structured liquid detergent composition.

13. A structured liquid detergent composition comprising:

from about 0.01 to about 0.10% by weight of a bacteria-derived cellulose network based on a total weight of said structured liquid detergent composition;

from about 20 to about 50% by weight of a plurality of surfactants based on a total weight of said structured liquid detergent composition, wherein said plurality of surfactants includes a linear alkylbenzene sulfonate and an alcohol ethoxylate, wherein a weight ratio of said linear alkylbenzene sulfonate to said alcohol ethoxylate is from about 0.6 to about 3.3;

from about 0.1 to about 6.0% by weight of polyethyleneimine ethoxylate based on a total weight of said structured liquid detergent composition;

at least 20% by weight of a non-aqueous solvent based on a total weight of said structured liquid detergent composition; and a balance being water;

wherein said structured liquid detergent composition has a low-stress viscosity of at least 20 Pa·s based on a maximum viscosity measured at a shear stress of from about 0.01 to about 0.20 Pa and a ratio of low-stress viscosity to high-stress viscosity of at least 50 measured at a shear stress of 10 Pa using an AR2000 rheometer using a 2 degree cone with 52 μm truncation at 25° C.

14. A unit dose detergent pack comprising:

a pouch formed from a water-soluble film; and a structured detergent composition releasably disposed within said pouch with said structured liquid detergent composition including:

a bacteria-derived cellulose network;

a plurality of surfactants including a linear alkylbenzene sulfonate and a nonionic surfactant with a weight ratio of said anionic surfactant to said nonionic surfactant being from about 0.5 to about 5.0;

polyethyleneimine ethoxylate present in an amount of from about 0.1 to about 6.0% by weight based on a total weight of said structured liquid detergent composition;

a non-aqueous solvent; and water.

15. The unit dose detergent pack as set forth in claim 14 wherein said structured liquid detergent composition has a low-stress viscosity of at least 3 Pa·s based on a maximum viscosity measured at a shear stress of from about 0.01 to about 0.2 Pa and a ratio of low-stress viscosity to high-stress viscosity of at least 10 measured at a shear stress of 10 Pa using an AR2000 rheometer using a 2 degree cone with 52 μm truncation at 25° C.

16. The unit dose detergent pack as set forth in claim 14 wherein said non-aqueous solvent is present in an amount of at least 20% by weight based on a total weight of said structured liquid detergent composition.

17. The unit dose detergent pack as set forth in claim 14 wherein said nonionic surfactant is an alcohol ethoxylate.

18. The unit dose detergent pack as set forth in claim 14 wherein:

said bacteria-derived cellulose network is present in an amount of from about 0.001 to about 1% by weight based on a total weight of said structured liquid detergent composition;

said plurality of surfactants is present in an amount of from about 5 to about 60% by weight based on a total weight of said structured liquid detergent composition; and said non-aqueous solvent is present in an amount of from about 20 to about 50% by weight based on a total weight of the structured liquid detergent composition.

19. The unit dose detergent pack as set forth in claim 14 wherein said water-soluble film is chosen from polyvinyl alcohol, polyvinyl acetate, film-forming cellulosic polymers, polyacrylic acid, polyacrylamide, polyanhydride, polysaccharide, and combinations thereof.

* * * * *